US009962762B2

(12) United States Patent
Guasch

(10) Patent No.: US 9,962,762 B2
(45) Date of Patent: May 8, 2018

(54) PISTON FOR COLD-CHAMBER INJECTION MACHINES

(71) Applicant: ALROTEC TECNOLOGY, S.L.U., Constantí (ES)

(72) Inventor: Jordi Alguero Guasch, Constanti (ES)

(73) Assignee: ALROTEC TECHNOLOGY, S.L.U., Constanti (ES)

( * ) Notice: Subject to any disclaimer, the term of this patent is extended or adjusted under 35 U.S.C. 154(b) by 0 days. days.

(21) Appl. No.: 15/120,361

(22) PCT Filed: Feb. 11, 2015

(86) PCT No.: PCT/ES2015/070084

§ 371 (c)(1),
(2) Date: Aug. 19, 2016

(87) PCT Pub. No.: WO2015/124813

PCT Pub. Date: Aug. 27, 2015

(65) Prior Publication Data

US 2017/0066047 A1 Mar. 9, 2017

(30) Foreign Application Priority Data

Feb. 21, 2014 (ES) ..... 201430233

(51) Int. Cl.
*B22D 17/20* (2006.01)
*B22D 17/08* (2006.01)

(52) U.S. Cl.
CPC ..... *B22D 17/203* (2013.01); *B22D 17/08* (2013.01)

(58) Field of Classification Search
CPC ..... B22D 17/203; B29C 45/53; F16J 1/005
(Continued)

(56) References Cited

U.S. PATENT DOCUMENTS 4,154,288 A 5/1979 Borgen
5,233,912 A * 8/1993 Mueller ..... B22D 17/203 277/451

(Continued)

FOREIGN PATENT DOCUMENTS

DE 102005048717 A1 4/2007
EP 1154192 A2 11/2001
JP S55165263 A 12/1980

OTHER PUBLICATIONS

International Search Report for PCT/ES2015/070084, dated May 14, 2015.

(Continued)

*Primary Examiner* — Kevin E Yoon
(74) *Attorney, Agent, or Firm* — Amster, Rothstein & Ebenstein LLP

(57) ABSTRACT

A PISTON FOR COLD-CHAMBER INJECTION MACHINES comprising a support (2) and an external body (3) with a sealing ring (5), joined by a bayonet lock ring (6) independent of the external body (3) and divided into two parts (6*a*) fitted onto a groove (21) in the support (2) and connected by long screws (7) inserted into threaded holes (61). The piston preferably includes a spring bush (4) as a part that adjusts to the container, independent of the external body (3) and of the bayonet lock ring (6), under which a conical spring ring (8) is included which exerts pressure on the two parts that form the bush (4), tending to expand the same. The piston also includes alternating transverse grooves (81) along the edges thereof for receiving conical metal tips (9) inserted through holes (63) in the bayonet lock ring (6).

7 Claims, 2 Drawing Sheets

(58) Field of Classification Search
USPC ..... 164/113, 312; 92/255–259
See application file for complete search history.

(56) References Cited

U.S. PATENT DOCUMENTS

| | | | | |
|---|---|---|---|---|
| 8,136,574 | B2 * | 3/2012 | Muller | B22D 17/203 164/312 |
| 8,931,395 | B2 * | 1/2015 | Brondolin | B22D 17/203 92/216 |
| 8,931,543 | B2 * | 1/2015 | Brondolin | B22D 17/203 164/312 |
| 9,463,505 | B2 * | 10/2016 | Murselaj | B22D 17/203 |

OTHER PUBLICATIONS

Spanish Translation of Written Opinion for PCT/ES2015/070084, dated May 13, 2016.

* cited by examiner

PISTON FOR COLD-CHAMBER INJECTION MACHINES

OBJECT OF THE INVENTION

The invention, as stated in the title of the present description, relates to a piston for cold-chamber injection machines, which provides several advantageous and innovative characteristics inherent to the particular configuration thereof, which is described in detail below and which amount to an improvement in the current state of the art.

The object of the present invention specifically relates to a piston applicable for cylinders of a die casting press, in particular for injecting liquid metal, preferably aluminium, which has the special feature of having a series of innovative structural details that, especially in relation to a bayonet lock and a conical spring, make the assembly of the external body thereof easier and improve its efficiency by optimising the vacuum capacity in die casting.

FIELD OF APPLICATION OF THE INVENTION

The field of application of the present invention falls within the industry sector dedicated to manufacturing pieces and elements for injection machines, and especially for the automobile sector.

BACKGROUND OF THE INVENTION

As it is known, as the weight of vehicles must be lighter, the pieces made of aluminium and magnesium used in basic elements in the construction of said vehicles must also decrease in weight. In order to do so, the vacuum technology in die casting is essential for achieving pieces with even thinner walls and porosity-free pieces, thus meaning that the entire injector unit must be adapted accordingly, the aim of the present invention being the development of a new piston for cylinders of the injection machines that use said vacuum technology, which has been improved in several aspects with the aforementioned intention.

In that regard, it should be noted that the piston presented herein is based on the known piston through patent EP0525229A1 owned by Allper A G concerning a "Piston, especially for pushing out liquid metal from a casting cylinder", which, although satisfactorily fulfilling the intended function and objectives, has various aspects that can be improved.

More specifically, the aforementioned piston is formed essentially from a cap or external body which is coupled to a support through a bayonet lock and a screw, one of the essential objectives of the present invention being to improve said locking system between the external body and the piston support, since the wear of the surface material of said body with the cylinder sleeve or container means that frequent replacement is necessary.

Moreover, given the application to which the piston of the invention is intended, the inner support preferably injects cooling fluid inside the external body, a second object of the present invention being to improve the cooling of the external body and, at the same time, extend the life thereof.

In reference to the current state of the art, it should be mentioned that, at least as far as the applicant is concerned, they are not aware of the existence of any other piston or invention with similar application having technical, structural and constituent characteristics similar to those of the invention claimed herein.

DESCRIPTION OF THE INVENTION

Thus, the invented piston for cold-chamber injection machines amounts to a noteworthy novelty within its field of application, since by employing it one may satisfactorily reach the aforementioned objectives, the characterising details that make it possible and set it apart being duly recorded in the claims included at the end of the present specification.

Specifically, the piston of the invention, which essentially conventionally comprises an external body that adjusts to the cylinder container or sleeve coupled to a support which is what moves, according to a first essential characteristic, includes a bayonet lock ring for securing said external body to said support, such that, unlike the hitherto known, it is a separate part from the rest of said external piston body.

Moreover, this locking ring, which has a configuration therein with four recesses that fit into four projections of a groove in the support into which it fits in order to achieve the aforementioned fastening, consists of two independent semicircular parts which are joined together, fitted onto the groove of the external body, through two screws.

In this way, the external body of a used piston may be quickly and practically disassembled and a new external body may be assembled, similarly enabling said external body to have different configurations to prevent the external body from constituting a complete wear piece.

Thus, this configuration of the aforementioned bayonet lock ring enables, for example, a bush to be fastened, between said locking ring and a sealing ring provided in the end of the external body, around said external body of the piston, this bush being the part of the piston that, as well as the aforementioned sealing ring, determines the surface that externally closes the piston inside the cylinder container and, therefore, that which suffers the greatest wear due to friction, such that, if it is only a bush the replacement thereof constitutes a saving compared to complete replacement of the external body of the piston itself as occurs in the prior art.

This bush may be manufactured in different materials and embodiments, as necessary in each case, such as spring bush, copper bush, wear bush made of different materials and/or different coatings.

Continuing with the characteristics of the invention, in a preferred embodiment thereof, the aforementioned bush is a spring bush manufactured from a copper plate, which guarantees during the manufacturing process a tension against the container, and it has the particular feature of having therein a conical spring ring that, mounted under the same, i.e. between the external body of the piston and the aforementioned spring bush, aims to adapt the diameter of the spring bush so that it adjusts to the expansion of the container and to counteract the wear of the bush, thanks to the expansive pressure that said ring itself exerts and a series of tips inserted therein and that may be successively further tightened depending on the aforementioned wear.

This enables the clearance between the container and the piston to be adjusted, which, in turn, ensures a high-grade vacuum, since, as has been mentioned in the previous sections, the piston of the invention is preferably intended for cylinders of injection machines that use vacuum technology.

Furthermore, given that the described conical spring ring is always in contact with the external body of the piston that is cooled via the aforementioned cooling fluid, the spring bush is also advantageously cooled to counteract the high temperatures that the liquid metal injected reaches, thus making it work better.

Another advantage that the piston proposed provides is the fact that the piece that suffers the greatest wear, i.e. the aforementioned spring bush, as it is smaller, constitutes cost savings, since the need to change the entire external body is avoided, whilst taking into account that the material it is made from, preferably copper, is expensive.

In conclusion, the design of the bayonet lock ring enables the external body of the piston to be easily changed and the sealing ring may be changed directly in the machine; thanks to the spring ring, the bush is a spring bush that adapts to the diameter of the container; and the cooling of the spring bush is ensured.

With these solutions, it is possible to achieve a high performance in the wear pieces. Furthermore, given that a high-grade vacuum may be achieved, resulting improved cast pieces are achieved and fewer piece rejections, as well as a shorter stopping time in the injection machines.

The described piston for cold-chamber injection machines therefore consists of an innovative structure with features heretofore unknown for their intended purpose, reasons which, taken together with its usefulness, provide it with sufficient grounds for obtaining the requested exclusivity privilege.

DESCRIPTION OF THE DRAWINGS

As a complement to the description provided herein, and for the purpose of helping to make the characteristics of the invention more readily understandable, the present specification is accompanied by a set of drawings constituting an integral part of the same, which, by way of illustration and not limitation, represent the following.

PREFERRED EMBODIMENT OF THE INVENTION

Figure 1:
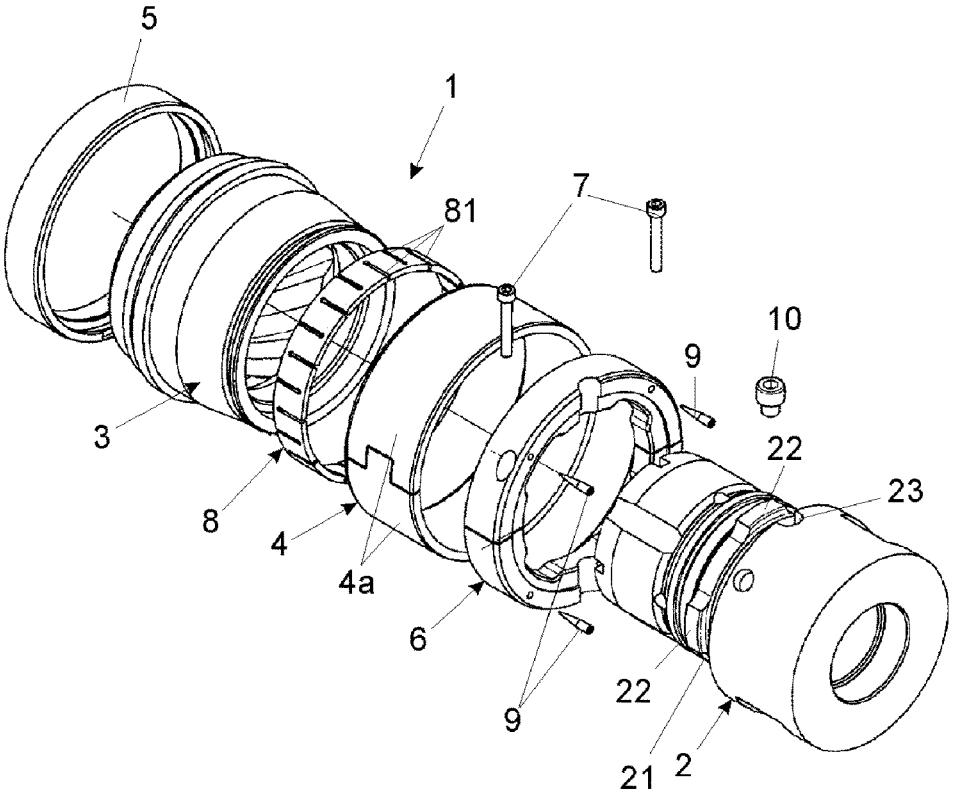
FIG. 1 shows a perspective exploded view of a exemplary embodiment of the piston for cold-chamber injection machines, in which the pieces and elements which it comprises, as well as the configuration of each of them may be seen.

In light of the aforementioned figures and in accordance with the adopted numbering, one may observe therein an example of a preferred, non-limiting embodiment of the piston for cold-chamber injection machines of the invention, which comprises the parts and elements that are indicated and described in detail below.

Thus, as may be seen in said figures, the piston (1) in question, that conventionally comprises a support (2) to which an external body (3) is coupled, upon which, in turn, a spring bush (4) is preferably included and a sealing ring (5) has the particular feature of having a bayonet lock ring (6) in order to achieve the fastening between said external body (3) and the support (2).

As has previously been explained, the support (2) links the piston (1) with the mechanisms of the machine that provides the movement thereto adjusted inside the container (not shown) in order to push the liquid metal to be injected, and cooling fluid is inserted through said support (2) inside the external body (3), which is hollow, to reduce the effects of the heat of the liquid metal thereon, transferring it to the bush (4) which is the piece that suffers most wear due to being the one that, as well as the sealing ring (5), adjusts to the walls of the container in order to achieve the vacuum therein, in this case being an independent piece of the external body (3) and the bayonet lock ring (6).

Figure 3:
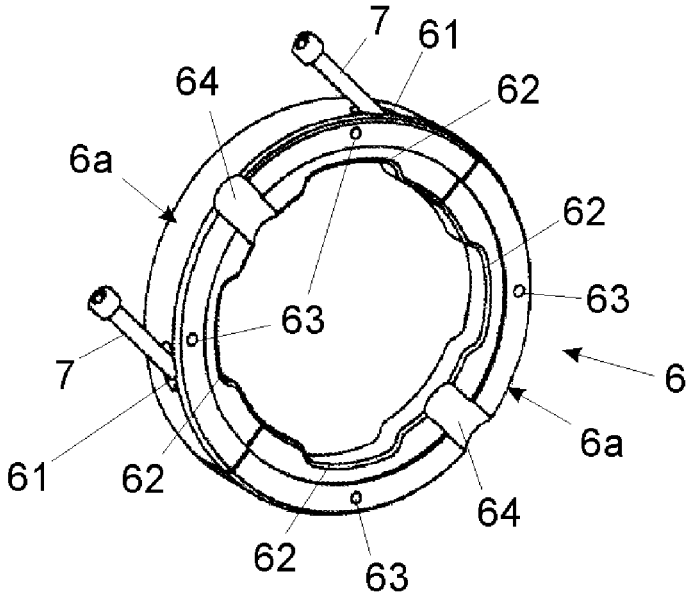
FIG. 3 shows a perspective view of the bayonet lock ring that the piston of the invention includes, showing the two parts that make it up and the configuration thereof.

In FIGS. 1 and 3 it may be seen how said bayonet lock ring (6) is divided into two semicircular parts (6*a*) that are joined to each other, fitted onto a groove (21) provided for this purpose in the support (2), via two long screws (7) inserted into threaded holes (61) made for this purpose in both parts of the ring itself.

Likewise, said figures shows the inner configuration of the bayonet lock ring (6) which has four recesses (62) that correspond with respective protuberances (22) of the aforementioned groove (21) of the support (2) into which it fits.

Figure 2:
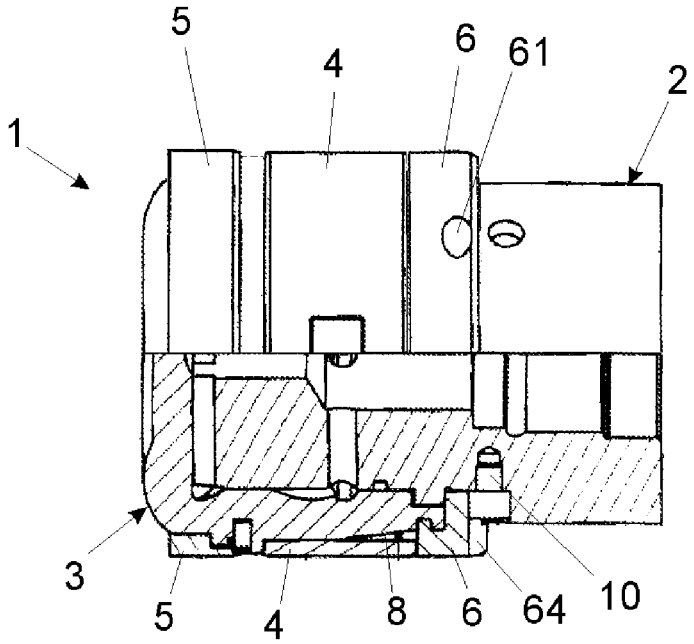
FIG. 2 shows a side elevation view, with a partial cross section, of the exemplary piston, according to the invention shown in the previous figure, shown in this case once all the pieces and elements which it comprises are mounted.

At the same time, the spring bush (4), which in a preferred embodiment of the invention is an independent piece of the external body (3), and includes, below the same and on the external body (3), a conical spring ring (8), as seen in FIG. 2, which exerts pressure on the bush (4), tending to expand the same.

In order to do so, this spring ring (8) has a series of transverse grooves (81) made alternately on the edges thereof that, as well as providing an expansive effect, thus meaning that once it is inserted between the external body (3) and the bush (4) it tends to press outwards on said bush (4), being suitable, at least those provided in the wide edge of the ring, for receiving the conical metal tips (9) that are inserted therein through holes (63) provided for this purpose in the bayonet lock ring (6).

Lastly it must be mentioned that at least one cut-out (64) is provided in the bayonet lock ring (6) that, located to coincide with another complementary cut-out (23) of the support (2), is intended to facilitate the passage of the head of a grub screw (10) that conventionally complements the fastening of the assembly.

Having thus adequately described the nature of the present invention, as well as how to put it into practice, it is deemed unnecessary to make this description any longer in order for anyone skilled in the art to understand the scope of the invention and the advantages deriving therefrom. It must be noted that, within its essential nature, the invention may be carried out according to other embodiments differing in detail from that set out by way of example, which the protection sought would equally cover, provided that the fundamental principle thereof is not altered, changed or modified.

The invention claimed is:

1. A piston for cold-chamber injection machines, which is applicable in injection machines with cylinder containers, and designed to move fitted to the walls of the cylinder container or sleeve, comprising, connected through at least one grub screw (10), a support (2) and an external body (3), characterised in that it includes a bayonet lock ring (6), to complement the fastening between the external body (3) and the support (2), said bayonet lock ring (6) constituting an independent piece of the external body (3).

2. The piston for cold-chamber injection machines, according to claim 1, characterised in that the bayonet lock ring (6) is divided into two semicircular parts (6*a*) that are joined to each other, and suitable to being fitted onto a groove (21) provided for this purpose in the support (2), through two long screws (7) inserted in threaded holes (61) made for this purpose in both parts of the ring.

3. The piston for cold-chamber injection machines, according to claim 1 or 2, characterised in that the bayonet lock ring (6) has four recesses (62) therein arranged to correspond with respective protuberances (22) of the support (2) itself.

4. The piston for cold-chamber injection machines, according to claim 1, characterised in that it includes a spring bush (4) as a piece that adjusts to the walls of the container, consisting of an independent piece of the external body (3) and the bayonet lock ring (6).

5. The piston for cold-chamber injection machines, according to claim 4, characterised in that, below the spring bush (4) and on the external body (3), it includes a conical spring ring (8), which exerts pressure on the bush (4) tending to expand the same.

6. The piston for cold-chamber injection machines, according to claim 5, characterised in that the spring ring (8) has a series of transverse grooves (81) made alternately on the edges thereof that, once inserted between the external body (3) and the bush (4), are what make it tend to press outwards on said bush (4).

7. The piston for cold-chamber injection machines, according to claim 6, characterised in that the transverse grooves (81) of the spring ring (8), at least those provided on the wide edge of the ring, are suitable for receiving conical metal tips (9) that are inserted therein through holes (63) provided for this purpose in the bayonet lock ring (6).

* * * * *